United States Patent [19]

Lubberts

[11] Patent Number: 4,994,858

[45] Date of Patent: Feb. 19, 1991

[54] ELECTROSTATOGRAPHIC APPARATUS FOR FORMING MULTICOLOR IMAGES ON A RECEIVING SHEET

[75] Inventor: Cor Lubberts, Webster, N.Y.

[73] Assignee: Eastman Kodak Company, Rochester, N.Y.

[21] Appl. No.: 440,161

[22] Filed: Nov. 22, 1989

[51] Int. Cl.[5] ..... G03G 15/00; G03G 15/01

[52] U.S. Cl. ..... 355/212; 355/327; 355/24; 355/319

[58] Field of Search ..... 355/212, 23, 24, 319, 355/326, 327

[56] References Cited

U.S. PATENT DOCUMENTS

| | | | |
|---|---|---|---|
| 3,820,985 | 6/1974 | Gaynor et al. . | |
| 3,856,295 | 12/1974 | Looney | 355/319 X |
| 4,013,359 | 3/1977 | DuBois et al. | 355/212 X |
| 4,099,150 | 7/1978 | Connin | 355/319 |
| 4,214,831 | 7/1980 | Reesen | 355/319 |
| 4,396,274 | 8/1983 | Kollar et al. | 355/212 |
| 4,580,889 | 4/1986 | Hiranuma et al. | 355/327 |
| 4,839,692 | 6/1989 | Shoji et al. | 355/327 X |

FOREIGN PATENT DOCUMENTS

| | | |
|---|---|---|
| 60-159862 | 8/1985 | Japan . |
| 63-96675 | 4/1988 | Japan . |

*Primary Examiner*—R. L. Moses

*Attorney, Agent, or Firm*—Leonard W. Treash, Jr.

[57] ABSTRACT

An endless imaging web is supported by a large diameter drum and at least one small diameter roller. First and second electrostatic images are created and toned on the same portion of the web as it is backed by the drum. The toners are of different color to create a multicolor image on the imaging web. The multicolor image is transferred to a receiving sheet, which receiving sheet is separated from the web as the web passes around the small diameter roller. Two small diameter rollers can be also provided which facilitate single-pass duplexing.

4 Claims, 1 Drawing Sheet

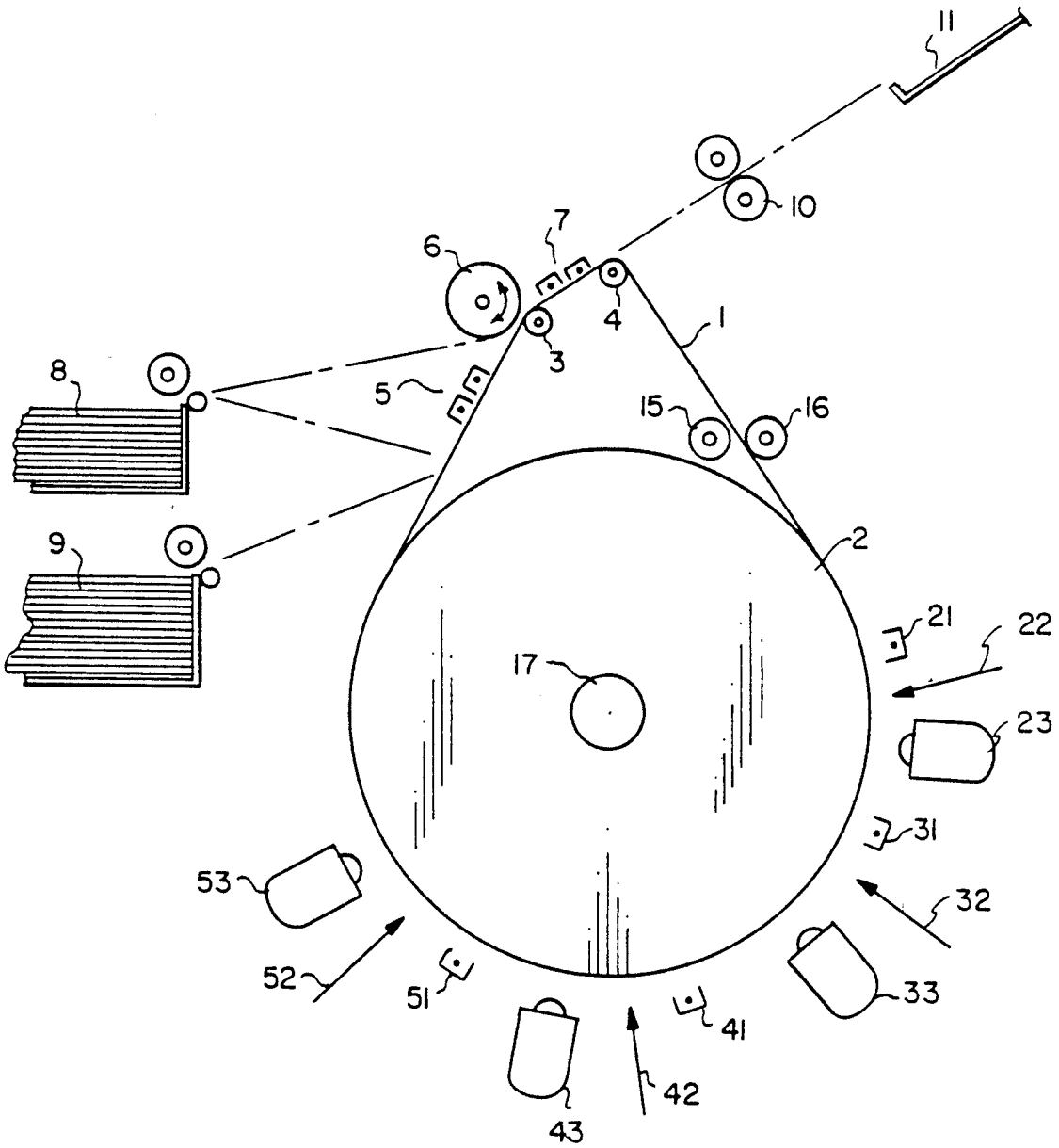
11
10
7
6
4
3
1
8
5
15
16
9
2
21
22
17
23
31
53
32
52
51
33
41
42
43

ELECTROSTATOGRAPHIC APPARATUS FOR FORMING MULTICOLOR IMAGES ON A RECEIVING SHEET

TECHNICAL FIELD

This invention relates to multicolor image forming apparatus, and more specifically to an apparatus for forming a multicolor toner image on a single frame of an electrophotographic imaging member from where it can be transferred in a single step to a receiving sheet.

BACKGROUND OF THE INVENTION

U.S. patent application Ser. No. 386,381, filed July 28, 1989, Mosehauer et al, shows an electrophotographic apparatus in which an electrostatic image is toned on the same area that already contains a loose toner image of a different color to create a multicolor image. The multicolor image is then transferred to a receiving sheet at a single transfer station. A large number of other references show this basic process; see, for example, U.S. Pat. Nos. 4,308,821; 4,629,669; 4,599,285 and 4,731,634.

This process eliminates registration problems at the transfer station common to structures in which separate toner images are created consecutively on an imaging member and then transferred to a recieving sheet that is brought into transfer relation with those images repetitively. However, in this process, registration between separate electrostatic image forming mechanisms must be maintained. The structure shown in the Mosehauer et al application requires both in-track and cross-track registration between LED printheads facing an imaging web supported by backing rollers.

The imaging web has the advantage of facilitating receiving sheet handling. As shown in that application, the web is trained around several small rollers which cause a change in direction of the web that facilitates separation of the receiving sheet. "Single-pass duplexing" is facilitated by the web.

However, all webs have tracking problems. Maintenance of cross-track and in-track registration between toner images is a challenge in designing and manufacturing color apparatus having a web imaging member. In-track registration is controlled in the Mosehauer et al structure by a sprocket and perforation system which automatically adjusts for variations in the speed and manufacture of the web. Reasonably good cross-track registration is obtained since the web has a tendency to follow itself over short distances reasonably well. However, for highest quality work even complex web tracking mechanisms are unable to prevent some noticeable cross-track misregistration. This becomes more critical as materials and exposure systems are improved and provide higher resolution.

U.S. Pat. Nos. 4,378,154; 4,624,549; 4,497,570 and 3,820,985 show an electrophotographic imaging apparatus in which a photoconductive web is trained around a large roller or drum and at least one or more small rollers. A small roller has the advantage shown, for example, in U.S. Pat. No. 4,378,154, of assisting in separation of a receiving sheet. The large roller or drum helps maintain good separation between image forming stations and the electrophotographic member.

FIG. 4 of U.S. Pat. No. 3,820,985 shows such a drum-web structure in a color imaging device. Registration problems are not addressed or corrected in this structure.

DISCLOSURE OF THE INVENTION

It is an object of the invention to provide apparatus for forming multicolor toner images on a receiving sheet, which apparatus includes a plurality of electrostatic image forming means consecutively forming images on the same frame, as in the prior art, but which has improved registration of the color images for making up the multicolor toner image and in which handling of the receiving sheet is convenient.

This and other objects are accomplished by an apparatus which includes an imaging web which is supported by a large diameter drum and at least one smaller diameter roller for movement through an endless path. The apparatus includes means for creating an electrostatic image on a portion of the imaging web backed by the large diameter drum and for toning said electrostatic image with a toner of a first color and means for creating a second electrostatic image also on the same portion of said imaging web and also where it is backed by said large diameter drum. The apparatus includes means for toning the second electrostatic image with a toner of a second color without disturbing the first toner image to create a loose multicolor toner image. Transfer means is provided for transferring the multicolor image to a receiving sheet. The apparatus includes means for separating the receiving sheet from the imaging web as the web passes around the smaller diameter roller.

With this structure the friction between the web and the supporting drum holds the web from movement as the electrostatic images are created thereby maintaining registration to an accuracy not maintainable by web tracking apparatus alone. However, the web imaging member is separated from the drum for receiving sheet handling.

According to a preferred embodiment of the invention the imaging web is supported by two small diameter rollers in addition to the large diameter drum and the two small diameter rollers are used to assist in handling the receiving sheet in doing single-pass duplexing.

BRIEF DESCRIPTION OF THE DRAWING

In the detailed description of the preferred embodiment of the invention presented below reference is made to the accompanying drawing which is a side schematic of a multicolor toner image producing apparatus constructed according to the invention.

DISCLOSURE OF THE PREFERRED EMBODIMENT

According to the drawing an imaging web, for example, endless photoconductive belt 1 is trained about large diameter drum 2 and two smaller diameter rollers 3 and 4. Belt 1 is driven by drum 2 past a series of image forming and toning stations to be described below which create a multicolor toner image on imaging web 1. Imaging web 1 also passes in a close transfer relation with a first transfer station 5, a turnover drum 6 and a second transfer station 7. Transfer stations 5 and 7 are supplied from receiving sheet supplies 8 and 9 and receiving sheets are ultimately fed through a fuser 10 and into an output tray 11.

To form the multicolor toner image, imaging web 1 is first charged at a first charging station 21 and exposed at a first exposure station 22 to create an electrostatic image. The electrostatic image is toned at a first toner station 23 with a toner of a first color, for example, black.

With the first toner image loosely held by the electrostatic image, the same area is again uniformly charged by a second charging station 31 to as much as possible equalize the charge in the image area. The imaging web 1 is again exposed at exposure station 32 to create a second electrostatic image and that electrostatic image is toned by a second toning station 33 which contains toner of a second color different from the first color thereby creating a multicolor toner image. This process can be repeated with charging stations 41 and 51, exposure stations 42 and 52 and toning stations 43 and 53 to add additional colors.

Although not limited thereto, this process works best in processes in which the toning stations tone discharged areas of the electrostatic image and do not have a tendency to clean off the earlier toning image. Such toning devices include "projection" or "jumping" toning systems and, as suggested in the above-mentioned Mosehauer et al patent application, development devices of the type disclosed in U.S Pat. No. 4,546,060, Miskinis et al issued Oct. 8, 1985.

The multicolor image is transferred to a receiving sheet fed from receiving sheet supply 8 or 9 to transfer station 5. A second multicolor image formed similar to the first image can be transferred to the opposite side of the receiving sheet. To accomplish this, the receiving sheet is turned over on turnover drum 6 without disturbing the first multicolor image and refed to the web 1 at transfer station 7 to receive the second multicolor image. This "single-pass duplexing" is done according to a scheme well-known in the art; see for example, U.S. Pat. No. 4,095,979 to DiFrancesco. With images on one or both sides the receiving sheet is then fed to fuser 10. Both images are fused simultaneously and then transported to output tray 11. Both sides of the web 1 are cleaned by cleaning devices 15 and 16. Cleaning device 15 also cleans drum 2.

This structure combines the advantages of a drum in registration of images as they are formed by exposure stations 22, 32, 42 and 52 with the advantages of the web in transfer and sheet separation associated with transfer stations 5 and 7. More specifically, it is critical in making a high quality multicolor image that the color images defined by the exposure stations 22, 32, 42 and 52 are in very tight registration. Any cross-track or in-track variation in the position of web 1 as it passes through these exposure stations will be noticeable in both loss of resolution of the image and in overlap or separation of colors with the creation of either white or colored borders to images. Modern electrophotographic materials and exposure systems are providing the capability of greater and greater resolution. Registration is becoming the most limiting aspect in producing highest quality color images.

In general, in-track registration problems are created by variation in the speed of the web while cross-track registration is affected by deviations in web tracking. The latter are not totally correctable even by sophisticated web tracking devices.

According to the invention friction between the drum 2 and web 1 holds the web in place as long as it receives all four exposures. Thus, as long as drum 2 does not vary in speed or lateral position neither will a single point on web 1. Cross-track position of drum 2 and its speed (due to its inertia) can be controlled to a much finer tolerance than can a web trained about small rollers. The invention thus improves registration of both cross-track and in-track directions.

As shown in the drawing the web 1 is in contact with the drum 2 and is driven by drum 2 throughout the portion of its path past exposure stations 22, 32, 42 and 52. With adequate friction between web 1 and drum 2 there is very small likelihood of any shift of the web with respect to the drum. The drum can be held a very close tolerance thereby maintaining extremely accurate registration. Thus, with this device the primary contribution to cross-track registration error from web tracking is eliminated. As in all endless web systems, a web tracking mechanism, for example, one based on edge guides, is required. However, with the invention, even the least expensive web tracking system gives better cross-track registration than prior devices with more elaborate and expensive active tracking systems.

In-track registration is also aided because the inertia of the drums steadies the speed of the web reducing flutter and other speed variations. Actual in-track control of image placement is accomplished by timing the exposures at exposure stations 22, 32, 42 and 52 off an encoder 17 which is responsive to the angular position of drum 2.

Significantly, the invention retains the advantages of a web. More specifically, small rollers 3 and 4 are used to train web 1 around corners which aid in receiving sheet handling. Rollers 3 and 4 are positioned to create a change in direction of web 1 thereby facilitating separation of the receiving sheet from the web for transport first to turnover drum 6 and then to the fuser 10. Obviously, if single-pass duplexing is not desired, small rollers 3 and 4 can be replaced by a single roller with one of the transfer stations 5 or 7 eliminated.

The exposure stations 22, 32, 42 and 52 are shown as leasers which, of course, can be a split of a single beam from a single laser separately modulated or they can be four separate lasers. They can also be other electronic exposure devices, for example, LED printheads or they can be ordinary optical exposure devices. The process works best in doing highlight color applications in which the discharged areas are toned. Electronic exposure is especially adapted to such negative-positive systems.

Thus, the invention provides an extremely productive multicolor image forming device which has the advantages of a web for handling of the receiving sheet and the advantage of a drum for maintenance of image registration.

The invention has been described in detail with particular reference to a preferred embodiment thereof, but it will be understood that variations and modifications can be effected within the spirit and scope of the invention as described hereinabove and as defined in the appended claims. For example, although an electrophotographic process is preferred to form the electrostatic images, they can also be formed the electrographic processes involving imagewise ion projection.

I claim:

1. Apparatus for forming multicolor toner images on a receiving sheet, said apparatus comprising:

an imaging web supported by a large diameter drum and a small diameter roller and moveable through an endless path, means for forming a first electrostatic image on a portion of said web as that web is backed by said drum, means for toning said first electrostatic image with a toner of a first color to create a first toner image, means for forming a second electrostatic image on the same portion of said web as said first toner image while said web continues to be backed by said drum, means for toning said second electrostatic image with the toner of a second color to create a multicolor image on said portion, means for transferring said multicolor image to a receiving sheet, and means for separating said receiving sheet from said web as said web passes around said smaller roller.

2. Apparatus according to claim 1 wherein said means for forming said first and second electrostatic images include means for imagewise exposing a uniformly charged web.

3. Apparatus according to claim 1 further including means for forming a third electrostatic image on said same portion of said web as said first and second toner image while said web continues to be backed by said drum, and means for toning said third electrostatic image with a toner of a third color to create a three-color multicolor image on said portion.

4. Apparatus according to claim 1 including a second smaller diameter roller and means for separating said receiving sheet from said web as said web passes around each such smaller diameter roller and further including means for inverting a receiving sheet after one such separation and for returning it to said web after such inversion.

* * * * *